US008673445B2

(12) United States Patent
Sato

(10) Patent No.: US 8,673,445 B2
(45) **Date of Patent: *Mar. 18, 2014**

(54) COMPOSITE-PLATED ARTICLE AND METHOD FOR PRODUCING SAME

(75) Inventor: Tomoyuki Sato, Nagano (JP)

(73) Assignee: Nissei Plastic Industrial Co. Ltd. (JP)

( * ) Notice: Subject to any disclaimer, the term of this patent is extended or adjusted under 35 U.S.C. 154(b) by 391 days.

This patent is subject to a terminal disclaimer.

(21) Appl. No.: 12/460,394

(22) Filed: Jul. 17, 2009

(65) Prior Publication Data

US 2011/0014493 A1 Jan. 20, 2011

(51) Int. Cl.
*B32B 9/00* (2006.01)

(52) U.S. Cl.
USPC ..... 428/408; 423/447.2

(58) Field of Classification Search
USPC ..... 428/408; 423/447.1; 977/742
See application file for complete search history.

(56) References Cited

U.S. PATENT DOCUMENTS

| | | | | | |
|---|---|---|---|---|---|
| 3,008,883 | A * | 11/1961 | Passal | 205/277 |
| 3,474,010 | A * | 10/1969 | McMullen et al. | 205/113 |
| 3,617,320 | A * | 11/1971 | Lee | 106/198.1 |
| 4,108,740 | A * | 8/1978 | Wearmouth | 101/348 |
| 5,116,430 | A * | 5/1992 | Hirai et al. | 148/518 |
| 6,106,927 | A * | 8/2000 | Zhong et al. | 428/141 |
| 2001/0001681 | A1* | 5/2001 | Zhang et al. | 427/508 |
| 2001/0025962 | A1* | 10/2001 | Nakamoto | 257/137 |
| 2003/0019756 | A1* | 1/2003 | Yoshida et al. | 205/88 |
| 2008/0008870 | A1* | 1/2008 | Sato et al. | 428/323 |
| 2010/0227154 | A1* | 9/2010 | Sato et al. | 428/323 |

FOREIGN PATENT DOCUMENTS

| | | |
|---|---|---|
| JP | 2001 283716 | 10/2001 |
| JP | 2008-163376 | * 7/2008 |

* cited by examiner

*Primary Examiner* — Maria Veronica Ewald
*Assistant Examiner* — Daniel H Miller
(74) *Attorney, Agent, or Firm* — Adams & Wilks

(57) ABSTRACT

A composite-plated article has a metallic material and a plating film coated on the metallic material in a nickel-plating bath containing carbon nanocomposite fibers. Each of the carbon nanocomposite fibers is formed of a carbon nanofiber core and microparticles that react with carbon to form a compound bonded to a surface of the carbon nanofiber core.

24 Claims, 5 Drawing Sheets

COMPOSITE-PLATED ARTICLE AND METHOD FOR PRODUCING SAME

BACKGROUND OF THE INVENTION

1. Field of the Invention

The present invention relates to a composite-plated article in which a composite-plating film comprising nickel or a nickel alloy compounded with a carbon nanocomposite fiber covers a metallic material, and to a method for producing the same.

2. Background Information

Nickel plating treatments have long been used in order to protect the surface of metallic materials and improve their design. In recent years, ultrafine carbon nanofibers have been brought into commercial use, and a variety of proposals have been made for applications concentrating on their strength, thermal conductivity, and electroconductivity. Among these proposals, a technique is known for mixing carbon nanofibers in a nickel-plating bath and performing composite plating as disclosed in, e.g., JP 2001-283716 A. The composite-plating technique disclosed in JP 2001-283716 A will be described next with reference to FIG. 7 hereof.

FIG. 7 shows a nickel plating film 102 with fullerenes 101 dispersed therein, the film being obtained by blending the fullerenes into a nickel plating bath, and performing an electric (electrolytic) plating treatment.

After having inspected the resulting film, the present inventors discovered that the strength of the nickel plating film 102 had not increased to the expected degree. They accordingly examined the nickel plating film 102 under a microscope, which revealed very fine gaps between the fullerenes 101 and the nickel plating film 102. If the fullerenes 101 move about within the nickel plating film 102, their reinforcing effect declines, and any increase in strength is minimized as a result. Accordingly, there is a demand for a composite-plating technique that receives the strengthening effect of the carbon nanofibers, while presenting no concerns regarding decreased strength.

The present inventors have previously proposed a method for adding carbon nanofibers to a Watts bath and obtaining a composite-plating film to improve surface roughness, as is disclosed in JP 2006-028636 A.

In JP 2006-028636 A there is disclosed a method for producing a fiber-shaped nanocarbon/metallic composite material, the method characterized in that a brightening agent, polyacrylic acid, and carbon nanofibers are mixed into a Watts bath containing mainly nickel sulfate and nickel chloride so that a composite-plating solution is obtained; a metallic material is introduced into the plating solution; and an electrolytic plating treatment is performed, whereby a composite-plating film in which a fibriform carbon nanomaterial is compounded with nickel attaches to the metallic material. According to this method, the brightening agent and the polyacrylic acid serve to produce a smoother plating film.

However, since carbon nanofibers are highly electroconductive, electrolytic plating will cause the plating film to form on surfaces of the carbon nanofibers. As a result, the smoothing effect obtained by the brightening agent and the polyacrylic acid is limited and inadequate, necessitating further smoothing to be performed.

SUMMARY OF THE INVENTION

It is an object of the present invention to provide a composite-plating technique whereby carbon nanofibers contribute an adequate increase in strength, and a plating film can be smoothened.

According to one aspect of the present invention, there is provided a composite-plated article obtained by applying a plating film to a metallic material in a nickel-plating bath into which carbon nanofibers have been mixed; the carbon nanofibers being carbon nanocomposite fibers in which microparticles that react with carbon and form a compound are bonded to surfaces of the carbon nanofibers.

Carbon nanocomposite fibers are thus used in the present invention. On reacting with carbon and forming a compound, the microparticles used in the carbon nanocomposite fibers will be securely bonded to the carbon nanofiber. The microparticles have good wettability in relation to nickel, and bond well therewith. There is no concern that deleterious gaps will form between the carbon nanofibers and the nickel base metal. As a result, it is possible to expect the strength to increase by adding the carbon nanofibers, and to readily obtain the desired mechanical properties.

Specifically, adequate mechanical properties can be obtained using a small amount of carbon nanofibers. Carbon nanofibers are electroconductive. Also, since they have a small diameter and a high aspect ratio, the smoothness of the plating film is readily compromised. Therefore, as long as the carbon nanofibers are added in small amounts, the smoothness of the plating film can be maintained.

The microparticles that react with carbon and form a compound are preferably made of Si. Si reacts with carbon (C) to form an SiC film. Bonding Si microparticles to the surfaces of the carbon nanofibers makes it possible to minimize the conductivity of their surfaces and inhibit the plating film from being deposited thereon, while increasing the smoothness of the plating film.

The plating film preferably includes phosphorus (P). Accordingly, adding P enables the mechanical properties to be further improved.

According to another aspect of the present invention, there is provided a method for producing a composite-plated article, comprising the steps of: bonding microparticles that react with carbon and form a compound to surfaces of carbon nanofibers and producing carbon nanocomposite fibers; mixing a brightening agent, a surfactant, and the carbon nanocomposite fibers into a nickel-plating solution to yield a composite-plating solution; and introducing a metallic material into the composite-plating solution to perform electrolytic plating; wherein the metallic material is covered by a composite-plating film obtained by combining nickel or a nickel alloy with the carbon nanocomposite fibers.

Carbon nanocomposite fibers are used. On reacting with carbon and forming a compound, the microparticles used in the carbon nanocomposite fibers will be securely bonded to the carbon nanofiber. The microparticles have good wettability in relation to nickel, and bond well therewith. There is no concern that deleterious gaps will form between the carbon nanofibers and the nickel base metal. As a result, it is possible to expect the strength to increase by adding the carbon nanofibers, and to readily obtain the desired mechanical properties.

Furthermore, since high-quality plated articles can be produced using common plating operations, the costs associated with producing these articles can be kept low.

The step for producing the carbon nanocomposite fibers preferably comprises mixing the carbon nanofibers with the microparticles that react with carbon and form a compound, placing a resulting mixture in a vacuum furnace, causing the microparticles to evaporate under high heat in a vacuum, and bonding the microparticles to the surfaces of the carbon nanofibers to produce the carbon nanocomposite fibers. Therefore, when the microparticles are vapor-deposited in a high-temperature vacuum, the carbon and microparticles will react to form carbides at the interfaces of the carbon nanofibers, and the microparticles will be uniformly and securely bonded thereto.

The mixing ratio between the microparticles that react with carbon to form a compound and the carbon nanofibers is preferably within a range of 1:1 to 1:10 expressed in terms of mass. If the ratio falls below 1:10; i.e., if the mass of the microparticles falls below one tenth of the mass of the carbon nanofibers, the microparticles will be present in insufficient quantities and will only react with some of the carbon nanofibers, so that the reaction will be irregular. If the ratio exceeds 1:1; i.e., if the mass of the microparticles is greater than the mass of the carbon nanofibers, there will be an excess of microparticles and an increase in the amount of extraneous microparticles that do not contribute to the reaction with the carbon nanofibers.

As long as the mixing ratio between the microparticles and the carbon nanofibers is from 1:1 to 1:10 in terms of mass, the microparticles can be caused to react with the surfaces of the carbon nanofibers, and the reaction ratio can be controlled according to the amount of microparticles added. Specifically, if the ratio is 1:1, the entire surface of the carbon nanofiber can be covered with the microparticles in an amount that is neither excessive nor inadequate, while if the ratio is 1:10, the microparticles can be bonded to one part of the surface of the carbon nanofiber.

The microparticles that react with carbon and form a compound preferably have an average size not exceeding 10 μm. If the average size of the microparticles exceeds 10 μm, the microparticles might not disperse evenly when mixed. If the microparticles disperse unevenly, the microparticles will be incapable of adhering uniformly to the carbon nanofiber. As long as the average size of the microparticles is less than 10 μm, the microparticles can bond uniformly to the entire surface of the carbon nanofiber.

The microparticles that react with carbon and form a compound are preferably made of Si. Si reacts with carbon (C) to form an SiC film. Bonding Si microparticles to the surfaces of the carbon nanofibers makes it possible to minimize the conductivity of their surfaces and inhibit the plating film from being deposited thereon, while increasing the smoothness of the plating film.

The plating film preferably includes phosphorus (P). Adding P enables the mechanical properties to be further improved.

The brightening agents are preferably saccharin sodium and 2-butyne-1,4 diol. Certain brightening agents are poorly compatible with dispersants (surfactants), forming unevenly on their surface, or weakening their function. Saccharin sodium and 2-butyne-1,4-diol have good compatibility with surfactants, and do not inhibit their function. As a result, the quality of the plating can be enhanced.

The surfactant is preferably polyacrylic acid. Adding polyacrylic acid enables aggregation of the carbon nanofibers to be minimized.

The polyacrylic acid is preferably mixed into the plating solution in an amount of 0.05 to 0.1 kg/m$^3$ per cubic meter of solution, and the carbon nanocomposite fibers are preferably mixed into the plating solution in an amount of 0.1 to 5 kg per cubic meter of solution. Adding the polyacrylic acid in an amount of 0.1 kg or less makes it possible to prevent decomposition products from precipitating in the plating solution, and yield a smooth plating.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
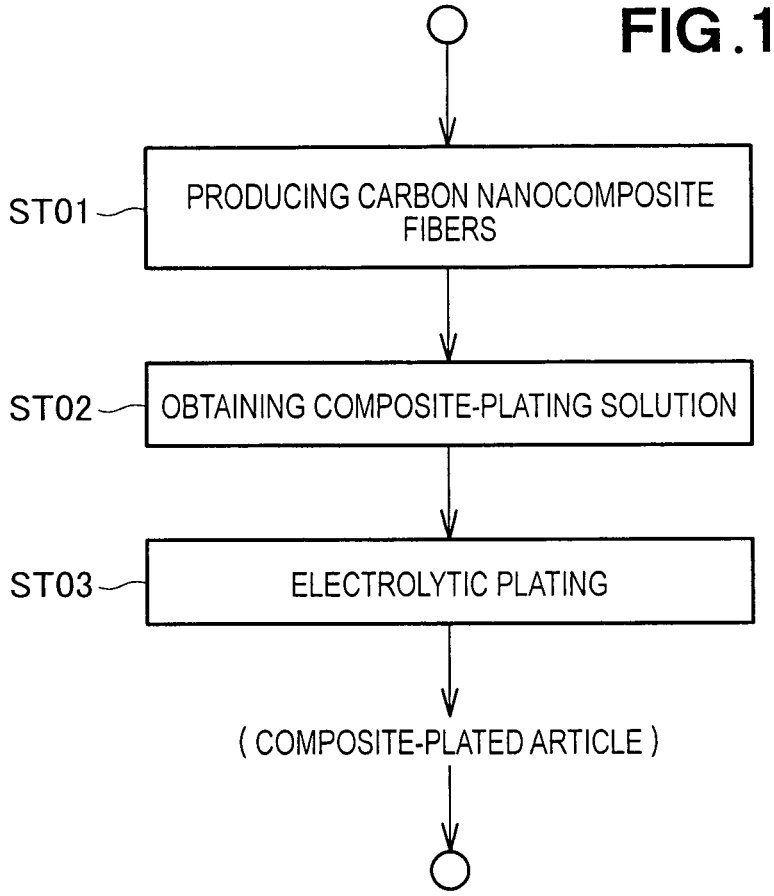
FIG. 1 is a flowchart showing steps for producing a composite-plated article according to the present embodiment.

As shown in FIG. 1, a process for producing a composite-plated article comprises a step (ST01) for producing carbon nanocomposite fibers in which microparticles that react with carbon and form a compound are bonded to surfaces of carbon nanofibers; a step (ST02) for mixing a brightening agent, a surfactant, and the carbon nanocomposite fibers into a nickel-plating solution, and obtaining a composite-plating solution; and a step (ST03) for introducing a metallic material into the composite-plating solution, and carrying out electrolytic plating.

Each of the steps ST01 to ST03 shown in FIG. 1 is described in detail hereinbelow.

Figure 2:
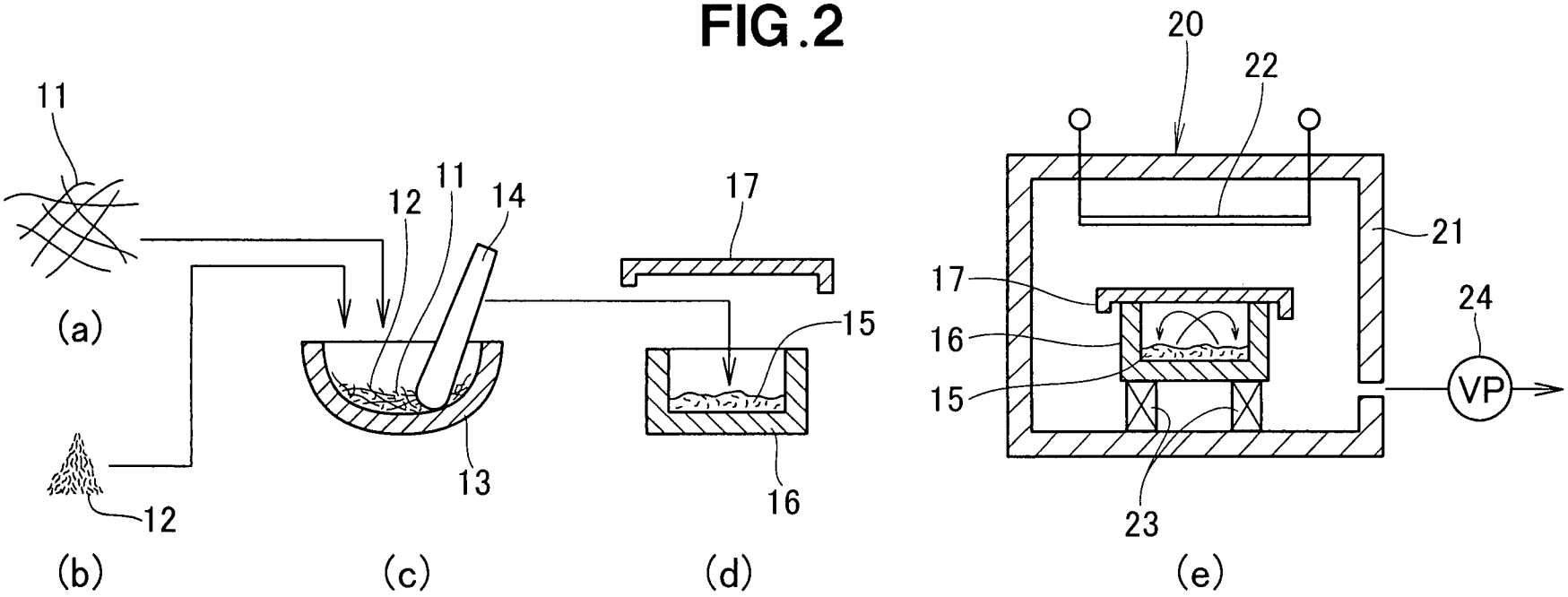
FIG. 2 is a diagram showing the step for producing carbon nanocomposite fibers indicated in ST01 of FIG. 1.

FIGS. 2(*a*) to (*e*) show a process for producing the carbon nanocomposite fibers shown in step ST01 in FIG. 1.

In FIG. 2(*a*), carbon nanofibers 11 are provided in an amount of, e.g., 10 g.

In FIG. 2(*b*), a Si powder 12 is provided in an amount of, e.g., 10 g for use as the microparticles that react with carbon and form a compound.

In FIG. 2(*c*), the carbon nanofibers 11 and the Si powder 12 are placed in a mortar 13 and mixed using a pestle 14 for 15 to 30 minutes.

In FIG. 2(*d*), the resulting mixture 15 is placed in an aluminum container 16, which is then covered by a lid 17. Using a non-hermetically-sealing lid enables air to circulate in and out of the container 16.

In FIG. 2(*e*), a vacuum furnace 20 is prepared, the vacuum furnace 20 comprising a hermetically sealed furnace body 21, heating means 22 for heating an interior of the furnace body 21, platforms 23 upon which the container 16 is placed, and a vacuum pump 24 for creating a vacuum inside the furnace body 21. The container 16 is placed inside the vacuum furnace 20.

Heating conditions in the vacuum furnace 20 will be described below; however, the Si powder in the mixture 15 will evaporate when heating is performed under a vacuum. The evaporated Si comes into contact with surfaces of the carbon nanofibers, forms a compound, and adheres to the carbon nanofibers as Si microparticles.

Figure 3:
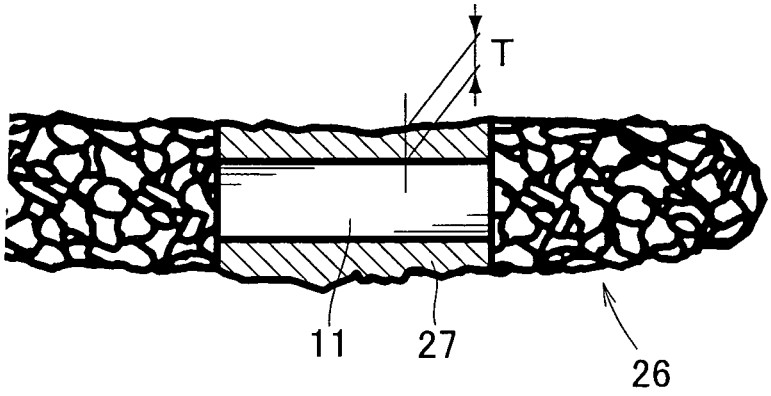
FIG. 3 is a schematic diagram showing a carbon nanocomposite fiber as observed using an electron microscope.

FIG. 3 shows a partially cut-away view of a resulting carbon nanocomposite fiber 26, as observed using an electron microscope. Specifically, the 25 carbon nanocomposite fiber 26 comprises a carbon nanofiber core 11, and a microparticle layer 27 covering a surface of the carbon nanofiber core 11 in a substantially uniform manner. A thickness T of the microparticle layer 27 is 20 to 80 nm, and is approximately 50 nm on average.

No Si peak was detected when X-ray diffraction was performed on the carbon nanocomposite fiber described above. Therefore, the Si microparticles likely formed into SiC through having contacted the carbon nanofiber.

Figure 4:
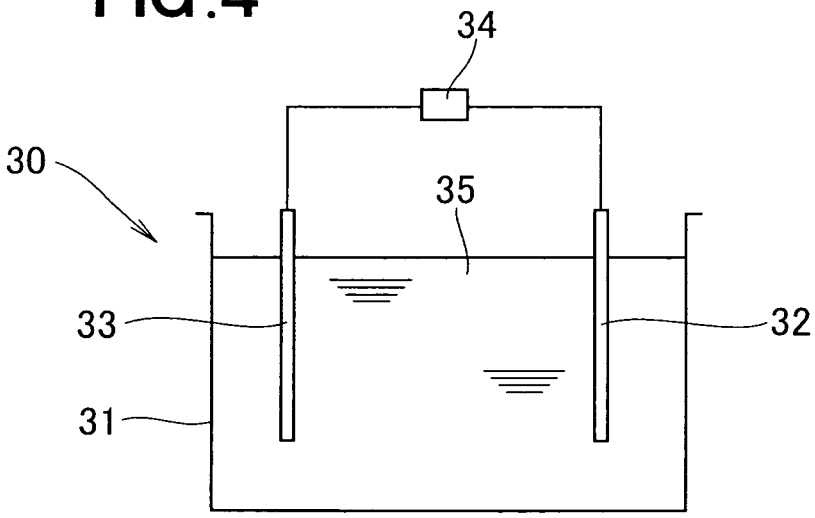
FIG. 4 is a diagram showing the solution-obtaining step and electrolytic plating step indicated by ST02 and ST03 in FIG. 1.

FIG. 4 shows the step for obtaining the plating solution and the electrolytic plating step shown in ST02 and ST03 from FIG. 1.

In an electrolytic plating apparatus 30, a nickel plate 32 functioning as an anode and a steel plate or another metal plate 33 functioning as a cathode are lowered into a plating tank 31, an electrical power source 34 is connected to both plates 32, 33, and the plating tank 31 is filled with a composite-plating solution (hereinafter referred to as a "plating solution") 35 described hereinbelow.

Stirring means and circulating means for stirring and circulating the plating solution 35 must be provided; however, since universally known means can be employed, a description thereof is omitted here.

In Comparative Example 1, the plating solution 35 is obtained by combining water, nickel sulfate, nickel chloride, boric acid, and a brightening agent. In Working Example 1, the plating solution 35 is obtained by combining water, nickel sulfate, nickel chloride, boric acid, a brightening agent, a surfactant, and carbon nanocomposite fibers. The amounts in which the components are mixed (added) will be described further below.

In Comparative Example 1, nickel ions attach to the metal plate 33, on which a nickel film is then formed.

In Working Example 1, nickel ions and the carbon nanocomposite fibers attach to the metal plate 33. Accordingly, a film having nickel and the carbon nanocomposite fibers in a mixed state is formed on the metal plate 33.

Comparative Example 1 and Working Example 1 are given as representative examples. Comparative Examples 2 to 4 and Working Examples 2 and 3 were produced; however, the details thereof are described in the sections concerning Comparative Example 1, Working Example 1, and the following experimental example.

EXPERIMENTAL EXAMPLE

An experimental example according to the present invention is described below, but is not provided by way of limitation to the invention.

Carbon nanocomposite fibers are produced for use in Working Examples 1 to 3. The nanofibers are produced under the conditions shown in Table 1.

TABLE 1

| | Working Example 1 | Working Example 2 | Working Example 3 |
|---|---|---|---|
| Microparticles | Si; ≤10μ | Si; avg. size: 4μ | Si; avg. size: 4μ |
| Amount of microparticles | 0.1 kg | 1 kg | 1 kg |
| Amount of carbon nanofibers | 1 kg | 1 kg | 1 kg |
| Reaction temperature | 1450° C. | 1200° C. | 1200° C. |
| Reaction time | 10 hrs | 20 hrs | 20 hrs |
| | ↓ | ↓ | ↓ |
| | (Si)-carbon nanocomposite fibers | | |

Conditions Under Which the Carbon Nanocomposite Fibers Used in Working Example 1 Were Produced Microparticles: Si; size: ≤10 μm
Amount of microparticles: 0.1 kg
Amount of carbon nanofibers: 1 kg
Temperature (reaction temperature) of the vacuum furnace 20 shown in FIG. 2(*e*): 1450° C.
Duration of treatment (reaction time) in the vacuum furnace 20 shown in FIG. 2(*e*): 10 hrs Conditions Under Which the Carbon Nanocomposite Fibers Used in Working Examples 2 and 3 Were Produced Microparticles: Si; average size: 4 μm
Amount of microparticles: 1 kg
Amount of carbon nanofibers: 1 kg
Temperature (reaction temperature) of vacuum furnace 20 shown in FIG. 2(*e*): 1200° C.
Duration of treatment (reaction time) in the vacuum furnace 20 shown in FIG. 2(*e*): 20 hours Following the manufacturing conditions described above allows the carbon nanocomposite fiber 26 shown in FIG. 3 to be obtained. The carbon nanocomposite fibers 26 are mixed into the nickel-plating solution shown in FIG. 4, and electrolytic plating is performed.

Conditions used for electrolytic plating in all examples
Cathode: SUS steel plate (clean and degreased)
Anode: electrolytic nickel plate
Plating solution temperature: 25° C.
Current density: 3 A/dm$^2$
Treatment time: 60 min Composition of Plating Solution Used in Comparative Example 1

Water: 1.0 m$^3$
Nickel sulfate: 240 kg/m$^3$
Nickel chloride: 45 kg/m$^3$
Boric acid: 30 kg/m$^3$
Brightening agent: 2-butyne-1,4-diol (0.2 kg/m$^3$) Saccharin sodium (2 kg/m$^3$)

Composition of Plating Solution Used in Comparative Example 2

The following substances were added to the composition of the plating solution of Comparative Example 1.
Surfactant: Polyacrylic acid (0.1 kg/m$^3$)
Hard microparticles: SiC; avg. size: 0.55 μm (0.2 kg/m$^3$)

Composition of Plating Solution Used in Comparative Example 3

The following substances were added to the composition of the plating solution of Comparative Example 1.
Surfactant: Polyacrylic acid (0.1 kg/m$^3$)
Carbon nanofibers: avg. size: 150 nm (2 kg/m$^3$)

Composition of Plating Solution Used in Comparative Example 4

The following substances were added to the composition of the plating solution of Comparative Example 1.
Surfactant: Polyacrylic acid (0.1 kg/m$^3$)
Carbon nanofibers: avg. size: 150 nm (0.2 kg/m$^3$)
Hard microparticles: SiC; avg. size: 0.55 μm (0.1 kg/m$^3$)

Composition of the Plating Solution Used in Working Examples 1 and 2

The following substances were added to the composition of the plating solution of Comparative Example 1.
Surfactant: Polyacrylic acid (0.1 kg/m$^3$)
Microparticle (Si)-bonded carbon nanofibers: 0.2 kg/m$^3$ Composition of the Plating Solution Used in Working Example 3

The following substances were added to the composition of the plating solution of Comparative Example 1.

Surfactant: Polyacrylic acid (0.1 kg/m$^3$)

Microparticle (Si)-bonded carbon nanofibers: 0.2 kg/m$^3$

Phosphorus acid: 2 kg/m$^3$

The plating solution compositions listed above are recorded in Table 2 below.

TABLE 2

| | Comp. Ex. 1 | Comp. Ex. 2 | Comp. Ex. 3 | Comp. Ex. 4 | Wrkg. Ex. 1 | Wrkg. Ex. 2 | Wrkg. Ex. 3 |
|---|---|---|---|---|---|---|---|
| Water | | | 1.0 m$^3$ | | | 1.0 m$^3$ | |
| Nickel sulfate | | | 240 kg/m$^3$ | | | 240 kg/m$^3$ | |
| Nickel chloride | | | 45 kg/m$^3$ | | | 45 kg/m$^3$ | |
| Boric acid | | | 30 kg/m$^3$ | | | 30 kg/m$^3$ | |
| Surfactant | | | 0.1 kg/m$^3$ | | | 0.1 kg/m$^3$ | |
| Brightening agent: 2-butyne-1,4-diol | | | 0.2 kg/m$^3$ | | | 0.2 kg/m$^3$ | |
| Saccharin sodium | | | 2 kg/m$^3$ | | | 2 kg/m$^3$ | |
| Carbon nanofiber (kg/m$^3$) | | | (Avg. size 150 nm) 2 | (Avg. size 150 nm) 0.2 | | | |
| Hard microparticles: SiC (kg/m$^3$) | | (Avg. size 0.55 μm) 0.2 | | (Avg. size 0.55 μm) 0.1 | | | |
| Si-carbon nanocomposite fiber (kg/m$^3$) | | | | | 0.2 | 0.2 | 0.2 |
| Phosphorus acid | | | | | | | 2 |
| Description | Glossy Ni plating | SiC/Ni composite Plating | CNF/Ni composite plating | SiC/CNF/Ni composite plating | Si + CNF/Ni composite plating | Si + CNF/Ni composite plating | Si + CNF/P/Ni composite plating |

Specifically, as noted in the last row of Table 2, Comparative Example 1 is a glossy nickel-plating solution.

Comparative Example 2 is a SiC/Ni composite-plating solution obtained by adding SiC to the glossy nickel-plating solution.

Comparative Example 3 is a CNF/Ni composite-plating solution obtained by adding carbon nanofibers (CNF) to the glossy nickel-plating solution.

Comparative Example 4 is a SiC/CNF/Ni composite-plating solution obtained by adding SiC and carbon nanofibers (CNF) to the glossy nickel-plating solution.

Working Examples 1 and 2 are Si+CNF/Ni composite-plating solutions obtained by adding Si-carbon nanocomposite fibers (Si+CNF) to the glossy nickel-plating solution.

Working Example 3 is an Si+CNF/P/Ni composite-plating solution obtained by adding Si-carbon nanocomposite fibers and phosphorus acid to the glossy nickel-plating solution.

A composite-plated article shown in FIG. 5 ("plated article" hereinafter) was produced using each of the plating solutions discussed above.

A plated article 37 shown in FIG. 5 comprises the metal plate 33 and a composite-plating film ("plating film" hereinafter) 38 covering the metal plate 33. The metal plate 33 is a steel plate 0.2 mm thick, 33 mm long, and 30 mm wide. The plating film 38 is approximately 40 μm thick.

Measurements were made of the roughness, abrasion resistance, and hardness of the surface of the article 37.

The surface roughness was measured using a laser microscope, and evaluated as excellent (◎) if the value was less than 0.5 μm, good (o) if the value was 0.5 to 1 μm, fair (Δ) if the value was greater than 1 μm and less than or equal to 2 μm, and poor (×) if the value was equal to or greater than 2 μm. (*2)

Figure 5:
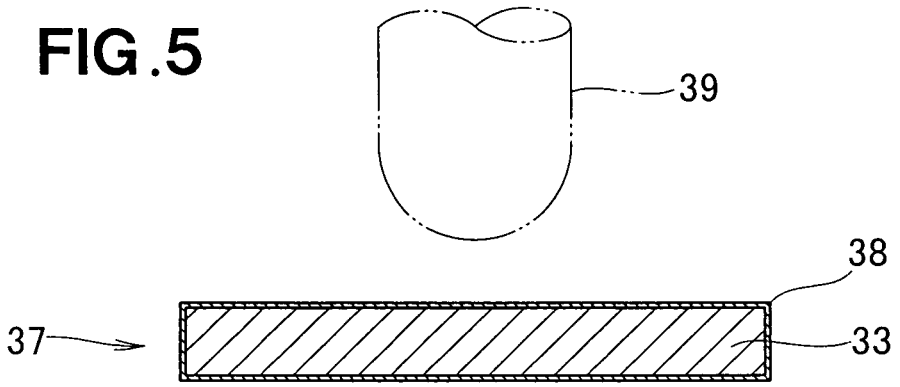
FIG. 5 is a cross-sectional view of a manufactured plated article.

A test to determine the abrasion resistance was performed by rubbing a test rod 39 shown by the imaginary line in FIG. 5 against the plating film 38. The test rod 39, which was made of steel, had on its distal end (lower end in FIG. 5) a spherical surface measuring 10 mm in diameter. The test rod was caused to contact the plating film with a pressing force of 300 g (approximately 3 N), and was caused to move reciprocatingly for 100 cycles over a distance of 10 mm at a speed of 1000 mm/min. The depth of the friction marks formed on the surface of the plating film 38 was measured using a laser microscope. The friction marks were preferably as small as possible. Accordingly, a depth of less than 10 μm was considered excellent (◎), 10 to 15 μm was considered good (o), and over 15 μm was considered poor (×).

The Vickers hardness was measured using a JIS (Japanese Industrial Standard)-compliant Vickers-hardness tester. In the present invention, a hardness of at least 700 and preferably 800 is desired; therefore, values of over 800 are considered excellent (◎), 700 to 800 good (o), and less than 700 poor (×).

The test results and evaluations are shown in Table 3 below.

TABLE 3

| | Comp. Ex. 1 | Comp. Ex. 2 | Comp. Ex. 3 | Comp. Ex. 4 | Wrkg. Ex. 1 | Wrkg. Ex. 2 | Wrkg. Ex. 3 |
|---|---|---|---|---|---|---|---|
| Abbreviation | Gloss Ni plating | SiC/Ni composite plating | CNF/Ni composite plating | SiC/CNF/Ni composite plating | Si + CNF/Ni composite plating | SiC + CNF/Ni composite plating | Si + CNF/P/Ni composite plating |
| Surface roughness Ra (μm) | 0.261 | 1.717 | 8.15 | 1.826 | 0.95 | 0.2 | 0.23 |
| Evaluation | ◎ | Δ | X | Δ | ○ | ◎ | ◎ |
| Friction-mark depth | 18.0 μm | 16.8 μm | 10.3 μm | 11.2 μm | 7.8 μm | 8.4 μm | 7.4 μm |
| Evaluation | X | X | ○ | ○ | ◎ | ◎ | ◎ |
| Vickers hardness | 552 | 705 | 751 | 723 | 738 | 712 | 812 |
| Evaluation | X | ○ | ○ | ○ | ○ | ○ | ◎ |
| General evalution | F | F | F | C | B | A | A |

An overall evaluation "F" was recorded in Table 3 when "×" was given for any of the three categories.

An overall evaluation "C" was recorded in Table 3 when "Δ" was given for any of the three categories.

An overall evaluation was "A" was recorded in Table 3 when "◎" was given at least twice in the three categories.

An overall evaluation of "B" was recorded in Table 3 when "o" was given for all three categories, or when "◎" was given once and "o" was given twice.

Since the friction-mark depth in each of Comparative Examples 1 and 2 exceeded 15.0 μm, and the abrasion resistance was low, the evaluation for the friction-mark depth was "×." As a result, the overall evaluation was "F."

In Comparative Example 3, since the plating layer included carbon nanofibers, the lubricating properties of carbon contributed to a "o" evaluation for abrasion resistance. However, since an excess of carbon nanofibers was added, the surface became darker, and the smoothness was compromised. Specifically, Comparative Example 3 was also given an overall evaluation of "F."

Working Examples 1 to 3 were given overall evaluations of "B" or "A." Comparative Example 3, which was compounded with a large amount (3 kg/m$^3$) of carbon nanofibers, had a surface roughness of 8.15 μm. In contrast, Working Examples 1 to 3, which were compounded with small amounts (0.2 kg/m$^3$) of Si-carbon nanocomposite fibers, had surface roughness values of 0.2 to 0.95 μm. Specifically, Working Examples 1 to 3 were regarded as being able to yield satisfactory results due to the fact that a small amount of carbon nanofibers was used.

In Working Example 3, phosphorus acid was added to the plating solution, whereby a plating film that included P was obtained. However, the plating film received high evaluations in each property; i.e., surface roughness, friction-mark depth, and Vickers hardness. Therefore, improvements in the properties of a plating film can be expected by including a small amount of P in the film.

In Working Example 1, carbon nanocomposite fibers were mixed into the plating solution in an amount of 0.2 kg per cubic meter of solution. The carbon nanocomposite fibers were produced by blending microparticles measuring 10 μm or less with carbon nanofibers in a ratio of 0.1 kg of the former to 1 kg of the latter, as indicated in Table 1. The reaction temperature was 1450° C. and the reaction was performed for 10 hours. It was not known whether the amount of 0.2 kg was suitable; accordingly, supplementary experiments were carried out as described below in order to investigate what amount of carbon nanocomposite fibers was suitable.

Conditions used for electrolytic plating in all supplementary experiments

Cathode: SUS steel plate (clean and degreased)

Anode: electrolytic nickel plate

Plating solution temperature: 25° C.

Current density: 3 A/dm$^2$

Treatment time: 60 minutes

Composition of plating solution used in the supplementary experiments

Water: 1.0 m$^3$

Nickel sulfate: 240 kg/m$^3$

Nickel chloride: 45 kg/m$^3$

Boric acid: 30 kg/m$^3$

Surfactant: Polyacrylic acid (0.1 kg/m$^3$)

Brightening agent: 2-butyne-1,4-diol (0.2 kg/m$^3$) Saccharin sodium (2 kg/m$^3$)

Supplementary Experiments 1 to 11

Si-carbon nanocomposite fibers: 1 to 6 kg/m$^3$

The Si-carbon nanocomposite fibers were produced at a (Si/carbon nanofiber) ratio of 1 to 10, a reaction temperature of 1450° C., and a reaction time of ten hours, as discussed above.

Eleven plated articles were fabricated under the above conditions, and measurements were made of the depth of marks created by friction in the plating film. The methods used to measure the depth of the friction marks and the surface roughness have already been described with reference to FIG. 5, and are accordingly not described here. The results are shown in Table 4 below.

TABLE 4

| Supplementary experiments | Experiment number 1 | 2 | 3 | 4 | 5 | 6 | 7 | 8 | 9 | 10 | 11 |
|---|---|---|---|---|---|---|---|---|---|---|---|
| Water | 1.0 $m^3$ | | | | | | | | | | |
| Nickel sulfate | 240 $kg/m^3$ | | | | | | | | | | |
| Nickel chloride | 45 $kg/m^3$ | | | | | | | | | | |
| Boric acid | 30 $kg/m^3$ | | | | | | | | | | |
| Surfactant | 0.1 $kg/m^3$ | | | | | | | | | | |
| Brightening agent: 2-butyne-1,4-diol | 0.2 $kg/m^3$ | | | | | | | | | | |
| Saccharin sodium | 2 $kg/m^3$ | | | | | | | | | | |
| Si:CNF | 1:10 | | | | | | | | | | |
| Reaction temp/time | 1450° C./10 hours | | | | | | | | | | |
| Si-carbon nanocomposite fibers ($kg/m^3$) | 0.1 | 0.2 | 0.3 | 0.4 | 0.5 | 0.7 | 1 | 1.5 | 2 | 4 | 6 |
| Surface roughness Ra (μm) | 0.79 ○ | 0.95 ○ | 1.57 Δ | 1.05 Δ | 1.49 Δ | 1.06 Δ | 0.90 ○ | 0.67 ○ | 1.01 Δ | 1.35 Δ | 1.03 Δ |
| Friction-mark depth (μm) | 9.72 ◎ | 7.84 ◎ | 8.26 ◎ | 7.76 ◎ | 9.2 ◎ | 11.04 ○ | 10.46 ○ | 11.00 ○ | 10.26 ○ | 12.36 ○ | 12.9 ○ |
| Vickers hardness | 766 ○ | 738 ○ | 734 ○ | 736 ○ | 712 ○ | 738 ○ | 746 ○ | 757 ○ | 738 ○ | 711 ○ | 748 ○ |
| Overall evaluation | B | B | C | C | C | C | B | B | C | C | C |

The evaluation symbols (e.g., "o") appearing next to the numbers in the rows for surface roughness, friction-mark depth, and Vickers hardness have the same meaning as described earlier.

Specifically, the surface roughness was measured using a laser microscope, and evaluated as excellent (◎) if the value was less than 0.5 μm, good (o) if the value was 0.5 to 1 μm, fair (Δ) if the value was greater than 1 μm and less than or equal to 2 μm, and poor (×) if the value was equal to or greater than 2 μm.

The friction-mark depth was evaluated as excellent (◎) if the value was less than 10 μm, good (o) if the value was 10 to 15 μm, and poor (×) if the value was greater than 15 μm.

The Vickers hardness was evaluated as excellent (◎) if the value was greater than 800, good (o) if the value was 700 to 800, and poor (×) if the value was less than 700.

An overall evaluation of "F" was recorded in Table 4 when "×" was given for any of the three categories.

An overall evaluation of "C" was recorded in Table 4 when "Δ" was given for any of the three categories.

An overall evaluation of "A" was recorded in Table 4 when "◎" was given at least twice in the three categories.

An overall evaluation of "B" was recorded in Table 4 when "o" was given for all three categories, or when "◎" was given once and "o" was given twice.

The amount of carbon nanocomposite fibers was investigated above on the basis of Experimental Example 1. An investigation performed on the basis of Working Example 2 will now be described.

In Working Example 2, as shown in Table 1, carbon nanocomposite fibers were mixed into the plating solution at an amount of 0.2 kg per cubic meter of solution. The carbon nanocomposite fibers were produced by blending microparticles having an average size of 4 μm with carbon nanofibers in a ratio of 1 kg of the former to 1 kg of the latter. The reaction temperature was 1200° C., and the reaction was performed for 20 hours. It was not known whether the amount of 0.2 kg was suitable; accordingly, supplementary experiments were carried out as described below in order to investigate what amount of carbon nanocomposite fibers was suitable.

Supplementary Examples 12 to 23

Si-carbon nanocomposite fibers: 1 to 10 $kg/m^3$

The Si-carbon nanocomposite fibers were produced at a (Si/carbon nanofiber) ratio of 1 to 1. The reaction temperature was 1200° C., and the reaction was performed for 20 hours, as discussed above.

Twelve plated articles were fabricated under the above conditions, and measurements were made of the depth of marks created by friction in the plating film. The methods used to measure the depth of the friction marks and the surface roughness have already been described with reference to FIG. 5, and are accordingly not described here. The results are shown in Table 5 below.

TABLE 5

| Supplementary experiments | Experiment number 12 | 13 | 14 | 15 | 16 | 17 | 18 | 19 | 20 | 21 | 22 | 23 |
|---|---|---|---|---|---|---|---|---|---|---|---|---|
| Water | 1.0 $m^3$ | | | | | | | | | | | |
| Nickel sulfate | 240 $kg/m^3$ | | | | | | | | | | | |
| Nickel chloride | 45 $kg/m^3$ | | | | | | | | | | | |
| Boric acid | 30 $kg/m^3$ | | | | | | | | | | | |
| Surfactant | 0.1 $kg/m^3$ | | | | | | | | | | | |
| Brightening agent: 2-butyne-1,4-diol | 0.2 $kg/m^3$ | | | | | | | | | | | |
| Saccharin Sodium | 2 $kg/m^3$ | | | | | | | | | | | |
| Si:CNF | 1:1 | | | | | | | | | | | |
| Reaction temp/time | 1200° C./20 hours | | | | | | | | | | | |
| Si-carbon nanocomposite fibers ($kg/m^3$) | 0.1 | 0.2 | 0.3 | 0.4 | 0.5 | 0.7 | 1 | 1.5 | 2 | 4 | 6 | 10 |
| Surface roughness Ra (μm) | 0.14 ◎ | 0.20 ◎ | 0.17 ◎ | 0.18 ◎ | 0.24 ◎ | 0.35 ◎ | 0.58 ○ | 0.5 ◎ | 0.76 ○ | 1.08 Δ | 0.98 ○ | 2.22 X |
| Friction-mark depth (μm) | 8.58 ◎ | 8.36 ◎ | 8.46 ◎ | 9.28 ◎ | 10.46 ○ | 12.82 ○ | 8.50 ◎ | 10.02 ○ | 13.54 ○ | 11.80 ○ | 12.46 ○ | 16.42 X |
| Vickers hardness | 711 ○ | 712 ○ | 713 ○ | 724 ○ | 715 ○ | 716 ○ | 712 ○ | 714 ○ | 712 ○ | 704 ○ | 708 ○ | 711 ○ |
| Overall evaluation | A | A | A | A | B | B | B | B | B | B | B | F |

The evaluation symbols (e.g., "o") appearing next to the numbers in the rows for surface roughness, friction-mark depth, and Vickers hardness have the same meaning as described earlier.

Specifically, the surface roughness was measured using a laser microscope, and evaluated as excellent (◎) if the value was less than 0.5 μm, good (o) if the value was 0.5 to 1 μm, fair (Δ) if the value was greater than 1 μm and less than or equal to 2 μm, and poor (×) if the value was equal to or greater than 2 μm.

A friction-mark depth of less than 10 μm was considered excellent (◎), 10 to 15 μm was considered good (o), and greater than 15 μm was considered poor (×).

A Vickers hardness value of over 800 was considered excellent (◎), 700 to 800 was considered good (o), and less than 700 was considered poor (×)

An overall evaluation of "F" was recorded in Table 5 when "×" was given for any of the three categories.

An overall evaluation of "A" was recorded in Table 5 when "◎" was given at least twice in the three categories.

An overall evaluation of "B" was recorded in Table 5 when "o" was given for all three categories, or when "◎" was given once and "o" was given twice.

Experiments 12 to 15 were given a overall evaluation of "A," and Experiments 16 to 22 were given a overall evaluation of "B;" however, Experiment 23 was given a overall evaluation of "F."

Experiments 1 to 11 shown in Table 4 were given overall evaluations of "B" or "C."

In Experiment 23, the amount of Si-carbon nanocomposite fibers was 10 $kg/m^3$, and the overall evaluation was "F." In contrast, the amount of Si-carbon nanocomposite fibers in Experiments 1 to 22 was 0.1 to 6 $kg/m^3$, and the overall evaluations were "C" or above.

It follows from the above data that Si-carbon nanocomposite fibers may be mixed into the plating solution in amounts of 0.1 to 6 $kg/m^3$ per cubic meter of plating solution.

As shown in Table 1, microparticles sized 10 μm or below were used in Working Example 1, and microparticles having an average size of 4 μm were used in Working Examples 2 and 3, the surface roughness, friction-mark depth, and Vickers hardness for each of these examples being good. Specifically, it can be confirmed from Working Examples 1 to 3 that better results are obtained when using smaller microparticles; i.e., not exceeding 10 μm.

A description has been given above of a case wherein the ratio between the Si microparticles and the carbon nanofibers is 1:10 (Table 4), and a case wherein the ratio is 1:1 (Table 5); however, it is also necessary to verify the intervening ratios.

Accordingly, supplementary experiments (Experiments 24 to 27) were carried out on the basis of Experiment 1.

Experiments 24 to 26 composition of the plating solution: same as in Experiment 1, except for the Si:carbon nanofiber ratio

TABLE 6

| Supplementary experiment | Experiment 1 | Experiment 24 | Experiment 25 | Experiment 26 |
|---|---|---|---|---|
| Amount of Si (kg) | 0.1 | 0.2 | 0.3 | 0.4 |
| Amount of carbon nanofibers (kg) | 1 | 0.8 | 0.7 | 0.6 |
| Si:CNF | 1:10 | 1:4 | 1:2.3 | 1:1.5 |
| Surface roughness Ra (μm) | 0.79 ○ | 0.63 ○ | 0.47 ◎ | 0.32 ◎ |

TABLE 6-continued

| Supplementary experiment | Experiment 1 | Experiment 24 | Experiment 25 | Experiment 26 |
|---|---|---|---|---|
| Friction-mark depth (μm) | 9.72 ◎ | 9.43 ◎ | 9.14 ◎ | 8.85 ◎ |
| Vickers hardness | 766 ○ | 752 ○ | 738 ○ | 725 ○ |
| Overall evaluation | B | B | A | A |

Experiment 24, in which the Si:carbon nanofiber ratio was 1:4, was given an overall evaluation of "B."

Experiment 25, in which the Si:carbon nanofiber ratio was 1:2.3, was given an overall evaluation of "A."

Experiment 26, in which the Si:carbon nanofiber ratio was 1:1.5, was given an overall evaluation of "A."

It can be confirmed from the above description that the mixing ratio between the microparticles that react with carbon to form a compound and the carbon nanofibers may be from 1:1 to 1:10 expressed in terms of mass.

0.1 kg/m$^3$ of polyacrylic acid was added as a surfactant in the abovedescribed Working Examples 1 to 3 and supplementary experiments (Experiments 1 to 26). The polyacrylic acid serves an important role in preventing aggregation of the carbon nanofibers. Therefore, the amount of polyacrylic acid added is significant. Accordingly, the correlation between the amount of carbon nanofibers and the amount of polyacrylic acid was investigated. The results are illustrated by FIG. 6.

Figure 6:
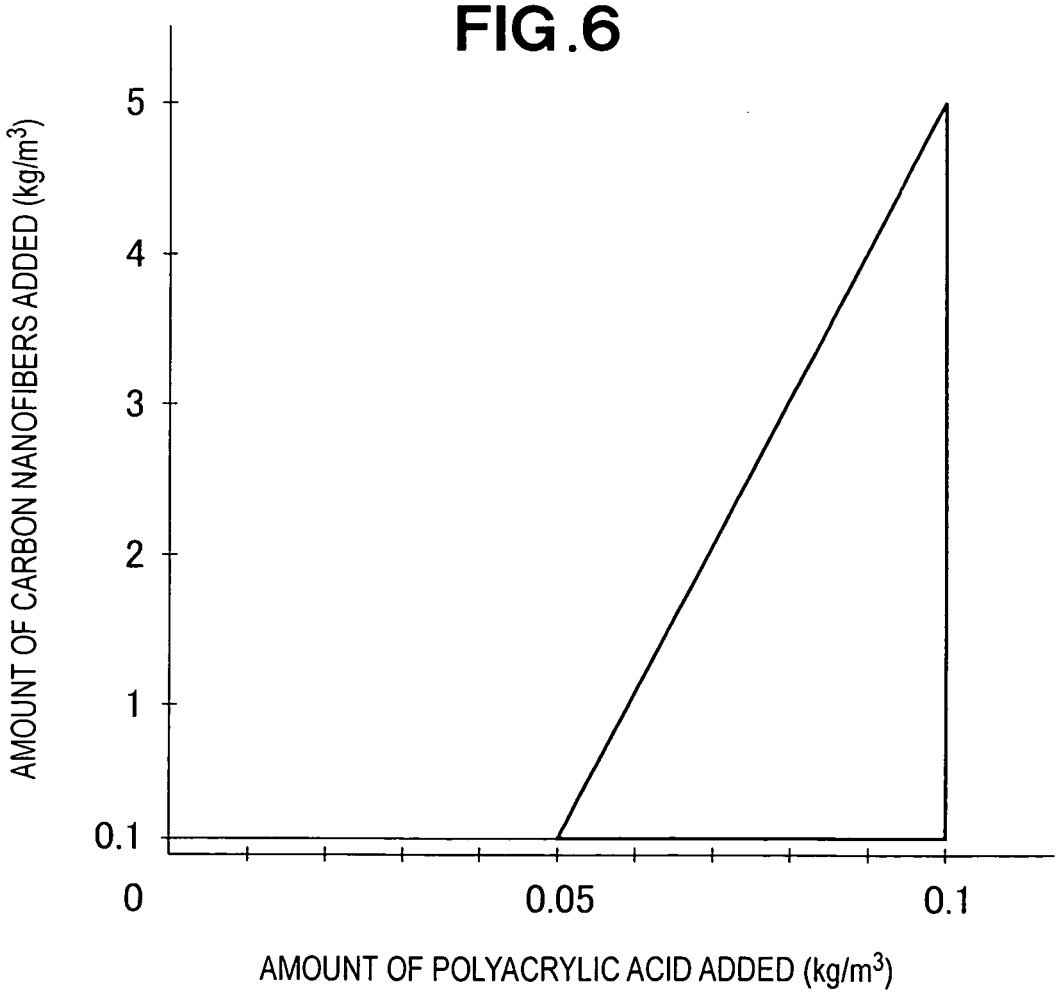
FIG. 6 is a graph showing the correlation between an amount of polyacrylic acid and an amount of carbon nanofibers.
Figure 7:
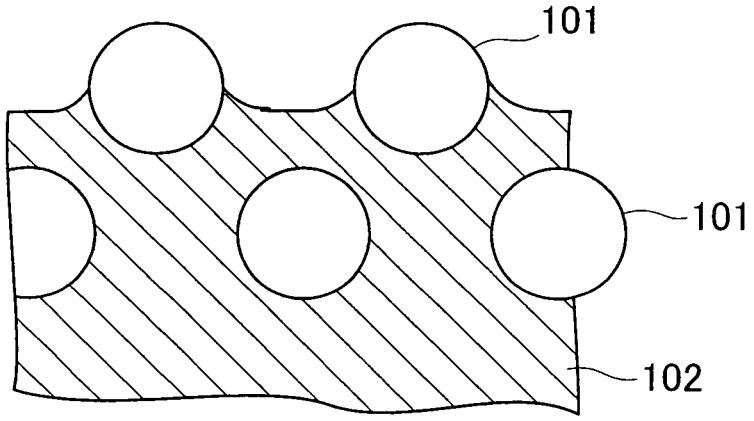
FIG.7 (PRIOR ART)
FIG. 7 is a schematic diagram showing a conventional composite-plating technique.

As shown in the graph appearing in FIG. 6, a good composited state was achieved when the amount of polyacrylic acid was 0.1 kg/m$^3$ and the amount of carbon nanofibers was in a range of 0.1 to 5 kg/m$^3$, in accordance with the data in Table 2. The amount of polyacrylic acid was then changed in a subsequent evaluation. The results showed that at an amount of less than 0.05 kg/m$^3$, the dispersion function weakened and the carbon nanofibers aggregated, whereas at an amount exceeding 0.1 kg/m$^3$, there was an excess of polyacrylic acid, decomposition products precipitated in the plating solution, and these precipitates reduced the quality of the plating.

Since the amount of polyacrylic acid should be increased in proportion to the amount of carbon nanofibers added, the suitable range lies within a large triangular region connecting the coordinates (0.05, 0.1), (0.1, 0.1), and (0.1, 5.0).

Specifically, polyacrylic acid is preferably mixed into the plating solution at an amount equal to 0.05 to 0.1 kg per cubic meter of solution, and the carbon nanocomposite fibers are preferably mixed into the plating solution at an amount equal to 0.1 to 5 kg per cubic meter of solution.

The nickel-plating bath may be one primarily comprising at least one nickel compound selected from the group consisting of nickel sulfate, nickel chloride, and nickel sulfamate; and is not limited to those used in the abovedescribed working or experimental examples.

Si microparticles are suitable for use as the microparticles that react with carbon and form a compound; however, if the intent is to improve the abrasion resistance, Ti may also be used, and can be selected as appropriate in accordance with that goal.

Experiments were also carried out using aluminum, copper, and iron plates for the metal plate 33, rather than the stainless steel plate. A plating film was deposited on each without difficulty, and in each case the operation and effect of the present invention were confirmed.

The metal plate 33 may be made of any metallic material capable of being plated, and is not limited as to shape.

What is claimed is:

1. A composite-plated article comprising: a metallic material; and a plating film coated on the metallic material in a nickel-plating bath containing carbon nanocomposite fibers each comprised of a carbon nanofiber core and microparticles that react with carbon to form a compound bonded to a surface of the carbon nanofiber core, the plating film having a surface roughness less than 1.0 μm.

2. A composite-plated article according to claim 1; wherein the microparticles that react with carbon and form a compound are made of Si.

3. A composite-plated article according to claim 1; wherein the plating film includes phosphorus (P).

4. A composite-plated article according to claim 1; wherein the surface roughness of the plating film is less than 0.5 μm.

5. A composite-plated article according to claim 1; wherein a mixing ratio between the microparticles that react with carbon to form a compound and the nanocomposite fibers is in a range of 1:1 to 1:10 expressed in terms of mass.

6. A method for producing a composite-plated article, comprising the steps of:

bonding microparticles that react with carbon and form a compound to surfaces of carbon nanofibers to produce carbon nanocomposite fibers;

mixing a brightening agent, a surfactant, and the carbon nanocomposite fibers into a nickel-plating solution containing nickel or a nickel alloy to obtain a composite-plating solution; and electroplating a metallic material in the composite plating solution to form thereon a composite-plating film having a surface roughness less than 1.0 μm.

7. A method according to claim 6; wherein the step for producing the carbon nanocomposite fibers comprises mixing the carbon nanofibers with the microparticles that react with carbon and form a compound; placing the resulting mixture in a vacuum furnace; causing the microparticles to evaporate under high heat in a vacuum; and bonding the microparticles to surfaces of the carbon nanofibers to produce the carbon nanocomposite fibers.

8. A method according to claim 7; wherein a mixing ratio between the microparticles that react with carbon to form a compound and the carbon nanofibers is in a range of 1:1 to 1:10 expressed in terms of mass.

9. A method according to claim 6; wherein the microparticles that react with carbon and form a compound have an average size not exceeding 10 μm.

10. A method according to claim 6; wherein the microparticles that react with carbon and form a compound are made of Si.

11. A method according to claim 6; wherein the nickel alloy includes phosphorus (P).

12. A method according to claim 6; wherein the brightening agents are saccharin sodium and 2-butyne-1,4-diol.

13. A method according to claim 6; wherein the surfactant is polyacrylic acid.

14. A method according to claim 13; wherein the polyacrylic acid is mixed into the nickel plating solution in an amount of 0.05 to 0.1 kg per cubic meter of solution, and the carbon nanocomposite fibers are mixed into the nickel plating solution in an amount of 0.1 to 5 kg per cubic meter of solution.

15. A method according to claim 6; wherein the composite-plating film is formed with a surface roughness less than 0.5 μm.

16. A composite-plated article comprising: a plating film containing nanocomposite fibers each comprised of a carbon nanofiber core and a microparticle layer covering the surface of the carbon nanofiber core, the microparticle layer comprising microparticles that react with carbon to form a compound; and a metallic material coated with the plating film; wherein the plating film has a surface roughness less than 1.0 μm.

17. A composite-plated article according to claim 16; wherein the microparticle layer covers the surface of the carbon nanofiber core in a substantially uniform manner.

18. A composite-plated article according to claim 16; wherein the microparticle layer has a thickness in the range of 20 nm to 80 nm.

19. A composite-plated article according to claim 18; wherein the microparticle layer has an average thickness of approximately 50 nm.

20. A composite-plated article according to claim 16; wherein the microparticles of the microparticle layer are made of Si.

21. A composite-plated article according to claim 16; wherein the plating film includes phosphorus (P).

22. A composite-plated article according to claim 21; wherein the microparticles of the microparticle layer are made of Si.

23. A composite-plated article according to claim 16; wherein the surface roughness of the plating film is less than 0.5 μm.

24. A composite-plated article according to claim 16; wherein a mixing ratio between the microparticles that react with carbon to form a compound and the nanocomposite fibers is in a range of 1:1 to 1:10 expressed in terms of mass.

* * * * *